US005515991A

United States Patent [19]

Heitland

[11] Patent Number: 5,515,991

[45] Date of Patent: May 14, 1996

[54] COSMETIC CONTAINER

[75] Inventor: Volker Heitland, Celle, Germany

[73] Assignee: Heitland und Petre International GmbH, Celle, Germany

[21] Appl. No.: 346,228

[22] Filed: Nov. 22, 1994

Related U.S. Application Data

[63] Continuation of Ser. No. 130,886, Oct. 4, 1993, abandoned.

[30] Foreign Application Priority Data

Oct. 2, 1992 [DE] Germany ..... 42 33 296.27

[51] Int. Cl.[6] ..... B65D 51/18

[52] U.S. Cl. ..... 220/256; 220/4.26; 220/8; 220/408

[58] Field of Search ..... 220/4.26, 8, 23.83, 220/256, 400, 408, 409, 528

[56] References Cited

U.S. PATENT DOCUMENTS

| | | | |
|---|---|---|---|
| 163,203 | 5/1875 | Howes | 220/408 |
| 342,397 | 5/1886 | Smith | 220/408 |
| 2,507,425 | 5/1950 | Swartout | 220/408 |
| 3,426,889 | 2/1969 | Fuller | 220/256 |
| 4,771,911 | 9/1988 | Morony et al. | 220/408 |
| 5,228,384 | 7/1993 | Kolosowski | 220/408 |

FOREIGN PATENT DOCUMENTS

| | | | |
|---|---|---|---|
| 1119475 | 12/1961 | Germany | 220/256 |

*Primary Examiner*—David T. Fidei
*Attorney, Agent, or Firm*—Longacre & White

[57] ABSTRACT

A cosmetics container, preferably made of either glass or of a plastic appearing similar to glass, includes a receiving segment with a planar bottom and which is sealable by an air-hermetic main cover. The container is designed in such a way that sealing is ensured and an intermediate container cover can be easily removed. For that purpose, at least one inwardly projecting step running parallel to the bottom is present at the receiving segment's inside surface and supports the intermediate cover, the outside surface of the intermediate cover being spaced from the vertical inside surface of the receiving segment so that when the intermediate cover rests on the step, a gap remains between the outside surface of the intermediate cover and the receiving segment inside surface. A hollow stub is joined to the lower side of the intermediate cover and has outside dimensions approximately matching the inside dimensions of the receiving segment including the gap. The inside of the hollow stub is accessible through an upward-pointing aperture passing through the intermediate cover.

9 Claims, 5 Drawing Sheets

COSMETIC CONTAINER

This is a continuation of Ser. No. 08/130,886, filed Oct. 4, 1993, now abandoned.

BACKGROUND OF THE INVENTION a) Field of the Invention

The invention concerns a cosmetics container, preferably constructed from either glass or plastic made to appear similar to glass. The container comprises a receiving segment with a planar bottom, is sealable by a hermetic cover, and further comprises an intermediate cover and inner container. The invention makes it possible to house two entirely different substances without the substances being able to mix.

b) Description of the Related Art

Known cosmetic containers comprise covers consisting of a conically tapering stopper cooperating with a matching inner cone of the container. In the closed state, the conical stopper sealingly rests against the container's inner cone.

Receptacles of this kind incur the drawback that in the event of unintentional pressure on the stopper, the stopper becomes wedged so hard against the container's inner cone that reopening container is difficult.

SUMMARY OF THE INVENTION

Accordingly, it is an object of the present invention to create a container of the initially cited kind which on one hand ensures sealing, and on the other hand allows easy removal of the container cover in any operational case.

This problem is solved by the present invention which provides at least one step projecting inwardly from the inside surface of a receiving segment. The at least one step extending horizontally parallel to the bottom surface of the receiving segment and supporting the edge of an intermediate cover. The radially outer surface of the intermediate cover is sized to be located at such a distance from the vertical inner surface of the receiving segment that when the intermediate cover has been deposited on the step, a gap remains between the outer surface of the intermediate cover and the inner surface of the receiving segment. A hollow stub projecting from the lower side of the intermediate cover has outer dimensions approximately matching the inner dimensions of the receiving segment so as to define a gap therebetween. The inside of the hollow stub is accessible through an upward-pointing aperture passing through the intermediate cover.

Furthermore, the stub joining the intermediate cover includes a bottom which is flat, at least on its outside, and which is spaced substantially from the inside of the planar bottom of the receiving segment. Such a design makes it possible to house two entirely different substances in the cosmetics container and to store them for long time intervals without the substances being able to mix. Obviously, mixing is possible if intentionally implemented.

In another especially advantageous aspect of the present invention, the container fitted with a main cover resting on an annular planar surface of the receiving segment opposite the planar bottom.

Advantageously, the main cover is fitted with a solid stub of which the dimensions correspond to those of inside the receiving segment and including gap therebetween.

In an especially advantageous aspect of the present invention, the inner container consisting of the intermediate cover and hollow stub are exchangeable, without thereby affecting the material or the substances within the receiving segment, and can be moved as a whole to a recycling station. Following consumption of the material in the inside container or following discontinuance of use, this inner container can be exchanged as a unit and be replaced by a new inner container filled with a new, uncontaminated material. The new inner container then provides the required sealing of the receiving segment in the manner described above.

Accordingly, there are two sealing surfaces in the present invention. A first sealing surface is between the intermediate cover and the horizontal step in the receiving segment, and a second sealing surface is between the intermediate cover and the main cover resting on the intermediate cover.

Therefore, especially susceptible materials may be stored behind the two sealing surfaces inside the receiving segment, and in spite of the reliable sealing, the individual parts, namely the main and the intermediate covers, can be easily removed from the receiving segment.

The container may have a triangular, square, rectangular, or other polygonal cross-section as well as a circular cross-section.

The invention is further elucidated below in relation to the illustrative embodiments shown in the drawings.

DESCRIPTION OF THE PREFERRED EMBODIMENT

Figure 1:
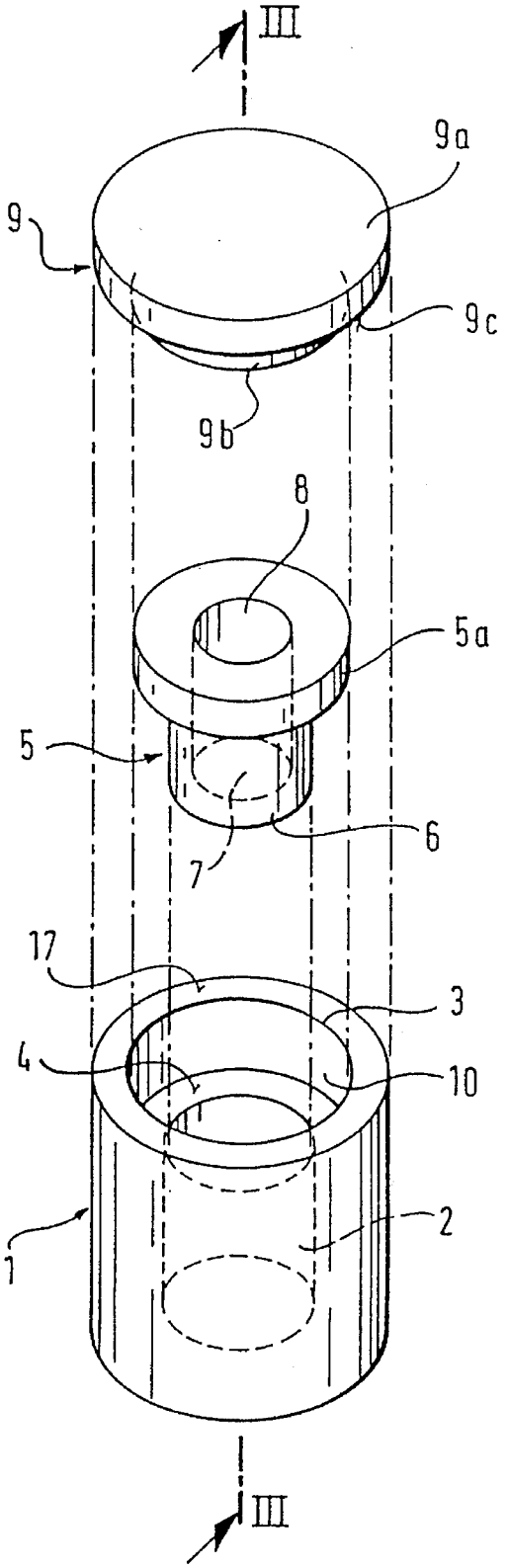
FIG. 1 is an exploded perspective view of an embodiment of the container according to the present invention.

FIG. 1 shows an embodiment of the container of the present invention which in this case assumes a cylindrical shape. Accordingly the individual container components each assume a circular cross-section.

The container of FIG. 1 consists of a cylindrical receiving segment 1 comprising a receiving space 2 which is also cylindrical (see FIG. 2) and open at the top by means of an aperture 3. In the zone of the receiving space 2, the inside surface of the receiving segment 1 comprises an inwardly projecting step 4 to support an intermediate cover 5 (also see FIG. 3) when the container is closed. The intermediate cover 5 comprises at its lower side a closed hollow stub 6 of lesser diameter and serving to receive a cosmetic. The intermediate cover 5 together with any residual material is exchangeable as a whole.

The inside space of the stub 6 is denoted by 7. This inside space is accessible from above by an aperture 8 passing through the intermediate-cover section 5*a* proper. When the intermediate cover 5 is in place, the cosmetic container as a whole is sealed by a main cover 9 consisting of an externally visible cover part 9*a* and a solid stub 9*b* adjoining its underside, the outside diameter of the cover part 9*a* corresponds to the outside diameter of the receiving segment 1 and the outside diameter of the stub 9*b* corresponds to the inside diameter of a recess 10 (also see FIG. 2) in the upper zone of the receiving segment 1 while a gap is subtended between stub 9*b* and receiving segment 1. The gap makes it possible to easily open the container in the described manner.

In corresponding manner the outside diameter of the intermediate cover 5*a* together with a gap matches the inside diameter of the recess 10, whereby the intermediate cover 5 is easily inserted into and removed from the recess.

Figure 2:
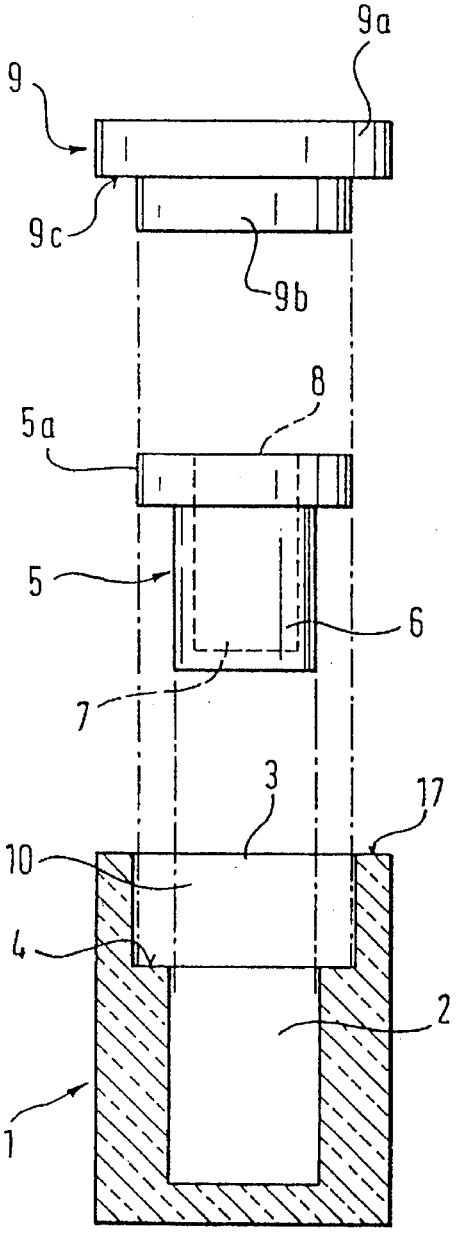
FIG. 2 shows a partial section and sideview of the container of FIG. 1.
Figure 3:
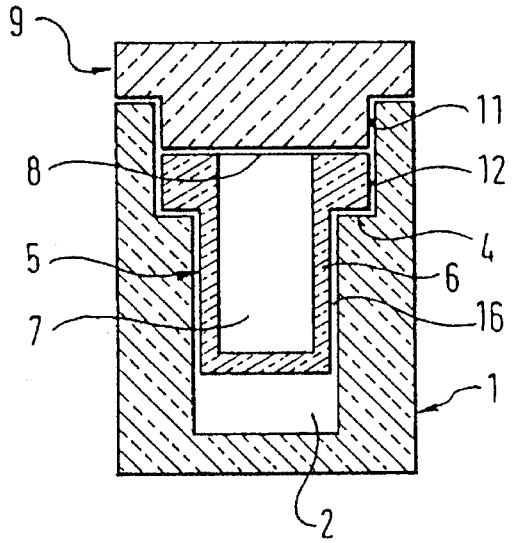
FIG. 3 is the container of FIGS. 1 and 2 shown in section and in the assembled state.

FIG. 3 is a schematic along the section III—III of FIG. 1 of the container of FIGS. 1 and 2 when in the assembled state. As shown by FIG. 3, the hollow stub 6 of the intermediate cover 5 in this embodiment is more shallow than the depth of the inside space 2 in the actual receiving segment 1, whereby another substance or part of the main substance may be housed in the residual space below the hollow stub 6. Obviously, too, the hollow stub 6 may be made long enough to correspond to the depth of the inside space.

For the sake of clarity, the individual components shown in FIG. 3 are shown not resting on one another but instead at some spacing from each other, however the shown vertical gaps 11 and 12 will always be present because of the preset diameter differentials. Thus, the components rest only at the horizontal surfaces.

Figure 4:
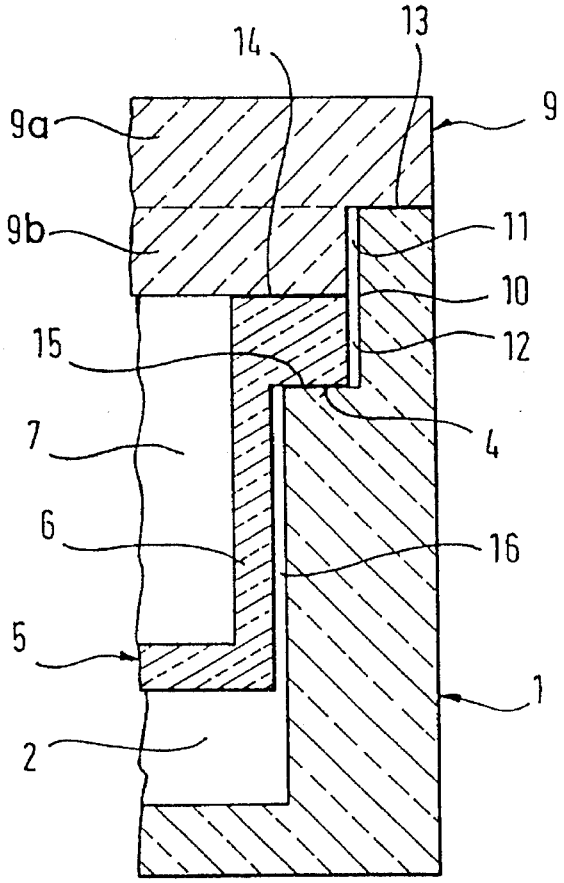
FIG. 4 is a cutaway from FIG. 3 on an enlarged scale to show more clearly the first, second and third sealing surfaces.

FIG. 4 is cutaway from FIG. 3 and clarifies the way the components rest on each other. The individual components rest on each other in the described manner at a third sealing surface 13, a second sealing surface 14 and a first sealing surface 15, whereby consecutive sealing surfaces are provided to ensure good tightness and easily allow reopening the container or the removal of the intermediate cover with its hollow stub 6.

Figure 5:
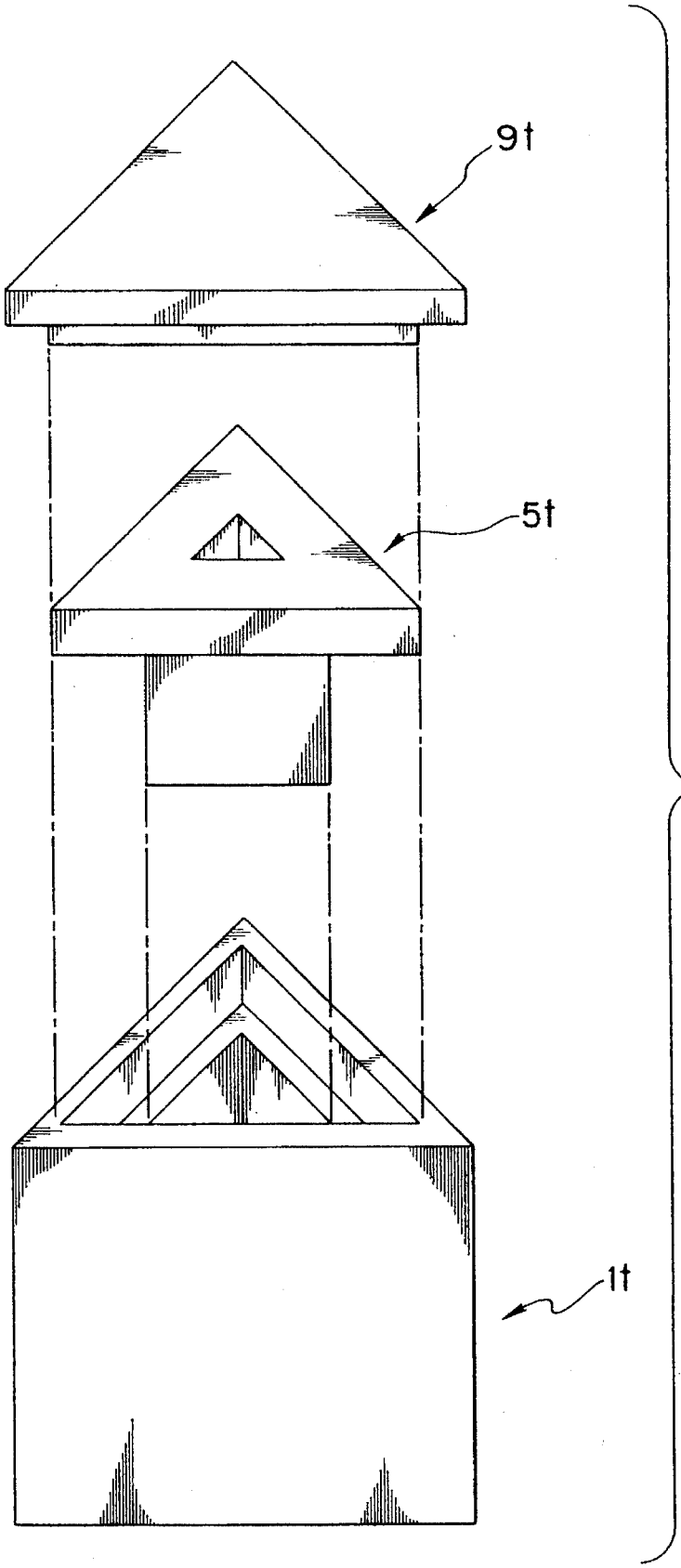
FIG. 5 is an exploded perspective view of a second embodiment of the container according to the present invention.
Figure 6:
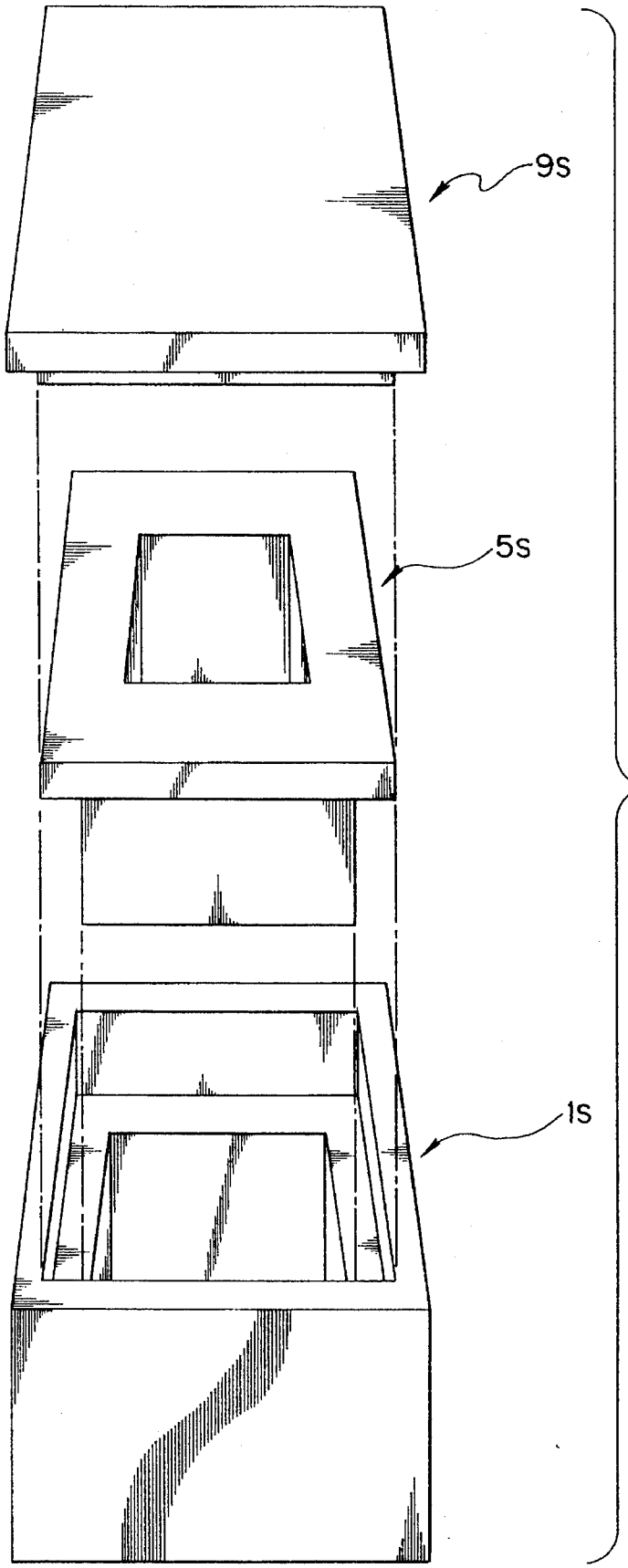
FIG. 6 is an exploded perspective view of a third embodiment of the container according to the present invention.
Figure 7:
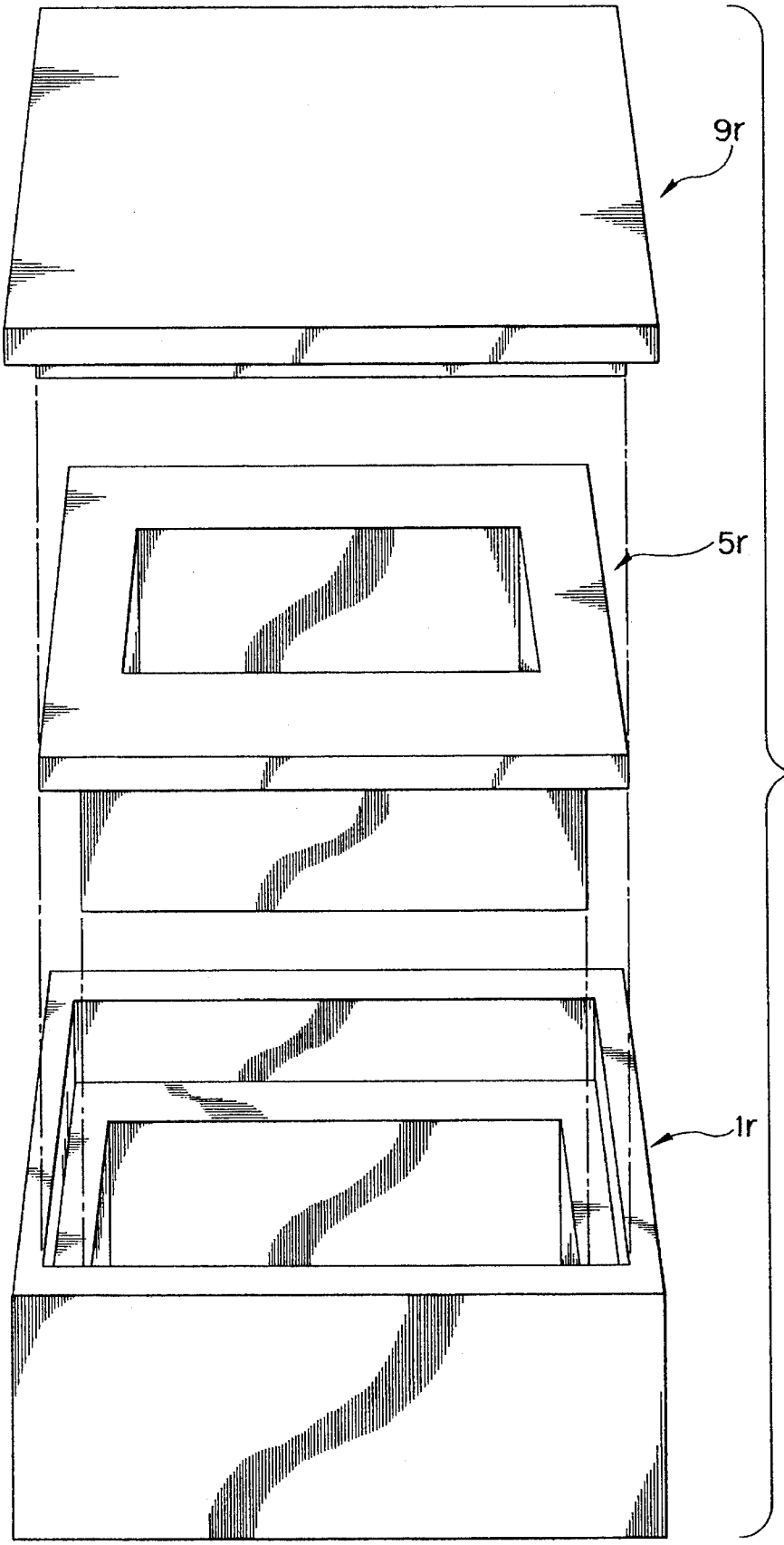
FIG. 7 is an exploded perspective view of a fourth embodiment of the container according to the present invention.

The invention is not restricted to the embodiment mode of a container with circular cross-section shown in the Figures. Other cross-sectional shapes of the container include a triangular cross-section (FIG. 5), rectangular cross-section (FIG. 7) or square cross-section (FIG. 6). With regard to FIGS. 5–7, the receiving segments are designated 1*t*, 1*s* and 1*r*, respectively. Similarly, the intermediate covers are designated 5*t*, 5*s* and 5*r*, respectively, and the main covers are designated 9*t*, 9*s* and 9*r*, respectively.

I claim:

1. A cosmetics container comprising:

a hollow receiving segment including a planar container bottom closing a lower end of said receiving segment;

at least one step prejecting inwardly from an interior surface of said receiving segment, said step projects parallel to said container bottom;

an intermediate cover supported on said at least one step, said intermediate cover and said at least one step providing a first sealing surface;

a first gap between a radially outermost periphery of said intermediate cover and said interior surface of said receiving segment;

a hollow stub extending from said intermediate cover toward said container bottom, said hollow stub includes an inside volume;

an aperture through said intermediate cover opening into said hollow stub;

a second gap between a radially outermost periphery of said hollow stub and said interior surface of said receiving segment;

a main cover including a solid stub extending from said main cover toward said intermediate cover, said main cover and said intermediate cover providing a second sealing surface, said main cover and said receiving segment providing a third sealing surface, said main cover having a radially outermost periphery congruent to a radially outermost periphery of said receiving segment; and, a third gap between a radially outermost periphery of said solid stub and said interior surface of said receiving segment.

2. The container defined in claim 1, characterized in that the hollow stub comprises a stub bottom which is a distance from said container bottom to form said receiving space.

3. The container defined in claim 1, characterized in that the inside area formed by the intermediate cover and the hollow stub is removably disposed within said container.

4. The container defined in claim 1, characterized in that the cross-section of the container is triangular.

5. The container defined in claim 1, characterized in that the cross-section of the container is square.

6. The container defined in claim 1, characterized in that the cross-section of the container is rectangular.

7. The container defined in claim 1, characterized in that the cross-section of the container is generally polygonal.

8. The container defined in claim 1, characterized in that the container evinces a circular cross-section.

9. The container as defined in claim 2, wherein said stub bottom is flat and parallel to said container bottom.

* * * * *